United States Patent [19]

Bell

[11] Patent Number: 4,620,835

[45] Date of Patent: Nov. 4, 1986

[54] PUMP PROTECTION SYSTEM

[75] Inventor: Gerald A. Bell, Bransholme Estate, England

[73] Assignee: American Standard Inc., New York, N.Y.

[21] Appl. No.: 616,110

[22] Filed: Jun. 1, 1984

[30] Foreign Application Priority Data

Jun. 2, 1983 [GB] United Kingdom ..... 83 15154

[51] Int. Cl.[4] ..... F04B 49/08

[52] U.S. Cl. ..... 417/17; 417/25; 417/38; 4/504

[58] Field of Search ..... 417/17, 25, 38, 44; 4/509

[56] References Cited

U.S. PATENT DOCUMENTS

| | | | |
|---|---|---|---|
| 2,765,743 | 10/1956 | Hollinshend | 417/44 |
| 2,933,570 | 4/1960 | Tutthill | 417/38 |
| 3,292,547 | 12/1966 | Ward | 417/7 |
| 3,679,325 | 7/1972 | Yost | 417/17 |
| 3,702,742 | 11/1972 | Russell | 417/25 |
| 3,716,306 | 2/1973 | Martin | 417/44 |
| 3,999,890 | 12/1976 | Niedermeyer | 417/38 |
| 4,070,133 | 1/1978 | McCormick | 417/38 |
| 4,115,878 | 9/1978 | Johnson | 128/66 |
| 4,233,694 | 11/1980 | Janosko | 4/509 |
| 4,476,889 | 10/1984 | Haynes | 417/44 |

FOREIGN PATENT DOCUMENTS

| | | |
|---|---|---|
| 343746 | 10/1973 | Austria . |
| 1560635 | 6/1964 | Fed. Rep. of Germany . |
| 1573660 | 4/1966 | Fed. Rep. of Germany . |
| 1810907 | 11/1968 | Fed. Rep. of Germany . |
| 1906609 | 2/1969 | Fed. Rep. of Germany . |
| 2533754 | 7/1975 | Fed. Rep. of Germany . |
| 1516356 | 7/1975 | United Kingdom . |

*Primary Examiner*—William L. Freeh

*Attorney, Agent, or Firm*—James J. Salerno, Jr.; Robert G. Crooks; John P. Sinnott

[57] ABSTRACT

To protect the pump of a whirlpool bath against running dry and against blockage at the inlet, a pressure (or flow) sensor 14 senses pump pressure and generates a signal to keep a switch S2 in the pump motor electrical supply circuit closed. If the pressure signal ceases owing to blockage or running dry, the switch S2 opens. A manual override button 15 is held ON to close switches S1*a* and S1*b* in the power circuit for start-up. The sensor 14 and manual button 15 are preferably air pressure devices. Switch S1*a* is preferably an air-signal-operated latching switch whereby with the pump operating, the button 15 can be operated to switch the pump off. Relays RLA 1 and 2 may be used in conjunction with the electrical switches. A bleed hole may be provided between the button 15 and switch S1*b* to limit the period of time for which the motor could be run, with the bath empty, by prolonged inadvertent actuation of the button 15.

15 Claims, 5 Drawing Figures

F. I G. 2

PUMP PROTECTION SYSTEM

This invention relates to a pump protection system for a liquid pump, notably a water pump, and particularly although not exclusively for a pump of a whirlpool bath. The invention also relates to a pump installation having a protection system.

In whirlpool baths, a pump is provided to pump the water from the bath (for example through a pump inlet located at the drain outlet of the bath) and to circulate the water back to the bath through nozzles in the side of the bath, thereby to create turbulence.

It is known to provide a protection system for a whirlpool pump which detects the presence of water in the system to protect the pump against running dry. One such system employs two electrodes let into the pipework which sense the presence of water by the establishment of electrical continuity between the electrodes. Another system senses a static pressure head of water in the pipework.

An obvious disadvantage of the electrode system is that of using electrical connections or elements in or near to the water, with the inherent difficulties of ensuring absolute safety. With the static pressure sensor, a disadvantage is that waves or vigorous water movement in a bath can result in inadvertent actuation or de-actuation.

However, the main disadvantage is that whilst known systems can protect a whirlpool pump against running dry, they are not adapted to protect a whirlpool pump from overheating in event of the inlet to the pump becoming blocked, as can happen in a whirlpool bath when an object such as a bathing cap, face flannel or the like covers the circulation pump inlet.

An aim of the present invention is to provide an improved protection system for a pump so as to protect it against damage and which is applicable to whirlpool pumps and possibly in other applications of pumps also.

According to one aspect of the present invention, there is provided a protection system for a liquid pump, comprising a sensor for sensing a flow characteristic of liquid flow through the pump and for producing a signal indicative of the existence of that characteristic, means for rendering the pump operative or inoperative in dependence upon the presence or absence of a signal from the sensor, and a manually operable override means operable to render the pump operative in the absence of a signal from the sensor.

Preferably, the means for rendering the pump operative or inoperative, and/or the manual override means, acts on the power supply to a motor for driving the pump, conveniently an electrical supply to an electric motor.

Alternatively, it would be possible for the signal from the sensor to be used to put the pump into a non-pumping mode, e.g. by adjusting the swashplate to a zero angle if a pump of that type is used, by dis-engaging a clutch in the pump drive, or by opening a by-pass duct so that the pump merely pumps a limited amount of water around its own by-pass circuit; this last alternative would be useful for protection if the pump inlet from the bath became blocked rather than for protection against running dry for which the pump drive would have to be rendered inoperative.

Advantageously, the manually operable override means is operable also as a switch to switch off the pump.

The sensor which senses the flow characteristic may be located at any suitable location so as to determine the flow condition through the pump, either in the pump itself, at its immediate inlet or outlet, or at any position between the pump circuit inlet from the bath and the discharge nozzles into the bath.

The sensor is preferably adapted to sense, as the flow characteristic, the dynamic operating pressure generated by the pump. This may be sensed at the inlet or outlet of the pump though the latter is simpler since the sensor merely has to sense a positive dynamic presure or an absence of such pressure. A pressure sensor at the inlet would have to be capable of sensing the normal reduced dynamic pressure (the operating suction pressure), an absence of pressure (if the pump runs dry) and a reduction below normal suction pressure as would occur if the pump inlet became blocked.

As an alternative to sensing the dynamic operating pressure, it might be possible to use a flow motion sensor in which case it could be located at the inlet or outlet since it would produce a signal by flow movement rather than in response to pressure as such.

The use of a dynamic operating pressure sensor is preferred however because it facilitates the use of non-electrical signals. Thus, according to a preferred feature of the invention, the sensor for sensing a dynamic pressure is adapted to generate a pneumatic signal which is used to operate a pneumatic-pressure responsive switch controlling the pump. Likewise, the manual override means preferably comprises a manual pneumatic switch which generates a pneumatic signal for operating a pressure-responsive switch. In this way the sensing and manual override switch means are non-electrical and are completely safe. This is especially relevant in the case where the pump is driven by an electric motor.

Air signal-generating devices are conveniently used as the pneumatic sensor and manual override means, preferably of the type in which a diaphragm or bellows is acted upon by the water pressure, or is pressed by a person using the manual switch, thereby to generate in each case an air pressure signal which is used to actuate an air-pressure diaphragm actuated switch. However, other forms of pressure transducers could be used to generate the dynamic pressure or override signals.

In the case where the pump is driven by an electric motor, the signal responsive switches may act directly upon the electrical power supply to the motor which drives the pump, provided the power current does not exceed the rating of the switches; for higher HP motors it is necessary to use relays so that the air-pressure actuated electrical switches control the operation of relays which in turn switch the power supply current.

Equally, if another form of power supply were used, the switches could either act directly upon that power supply or indirectly via servo means.

Where the manual override serves also as an 'OFF' switch to switch the pump off, it is conveniently connected to two signal-responsive switches, one for overriding the protection system and the other a latching switch establishing a control line in series with the protection switch connected to the sensor. Thus with the pump operating, actuation of the manual override will serve to switch off the latching switch and render the pump inoperative.

In use, the pump protection system of the invention is effective both to protect a pump against running dry, as for example if the water from a whirlpool bath is drained out while the pump is operating, and also automatically to switch the pump off if the inlet becomes blocked causing a change in the flow conditions through the pump.

To avoid damage if the manual override switch is held on with no water in the pump, means is preferably provided to limit the period of time of effective operation of the manual override switch, such as a small bleed hole or calibrated orifice in the pneumatic line connecting that switch to the pressure-responsive switch.

The pump protection system of the invention is particularly suitable for a whirlpool bath but could be also useful to protect the circulation pump of a swimming pool or the pressure developing pump of a shower.

In domestic applications and where electric motors are used, safety is of paramount importance and the use of pneumatic switches and sensors is seen as an advantageous feature. According to a second aspect of the invention, therefore, there is provided a domestic pump installation for a bath or shower, having a pump driven by an electric motor, a pump protection system including a sensor for sensing operating conditions and a manually operable switch for controlling the pump, wherein the sensor and manually operable switch are pneumatic signal-generating devices connected to actuate remote electrical switching controlling the motor.

For safety reasons also, the pump is preferably made of a non-conducting material, e.g. plastics, and all the water contacting parts are isolated from the pump motor.

The invention may be put into practice in a number of ways but certain specific embodiments will now be described by way of example only with reference to the accompanying drawings, in which.

Figure 1:
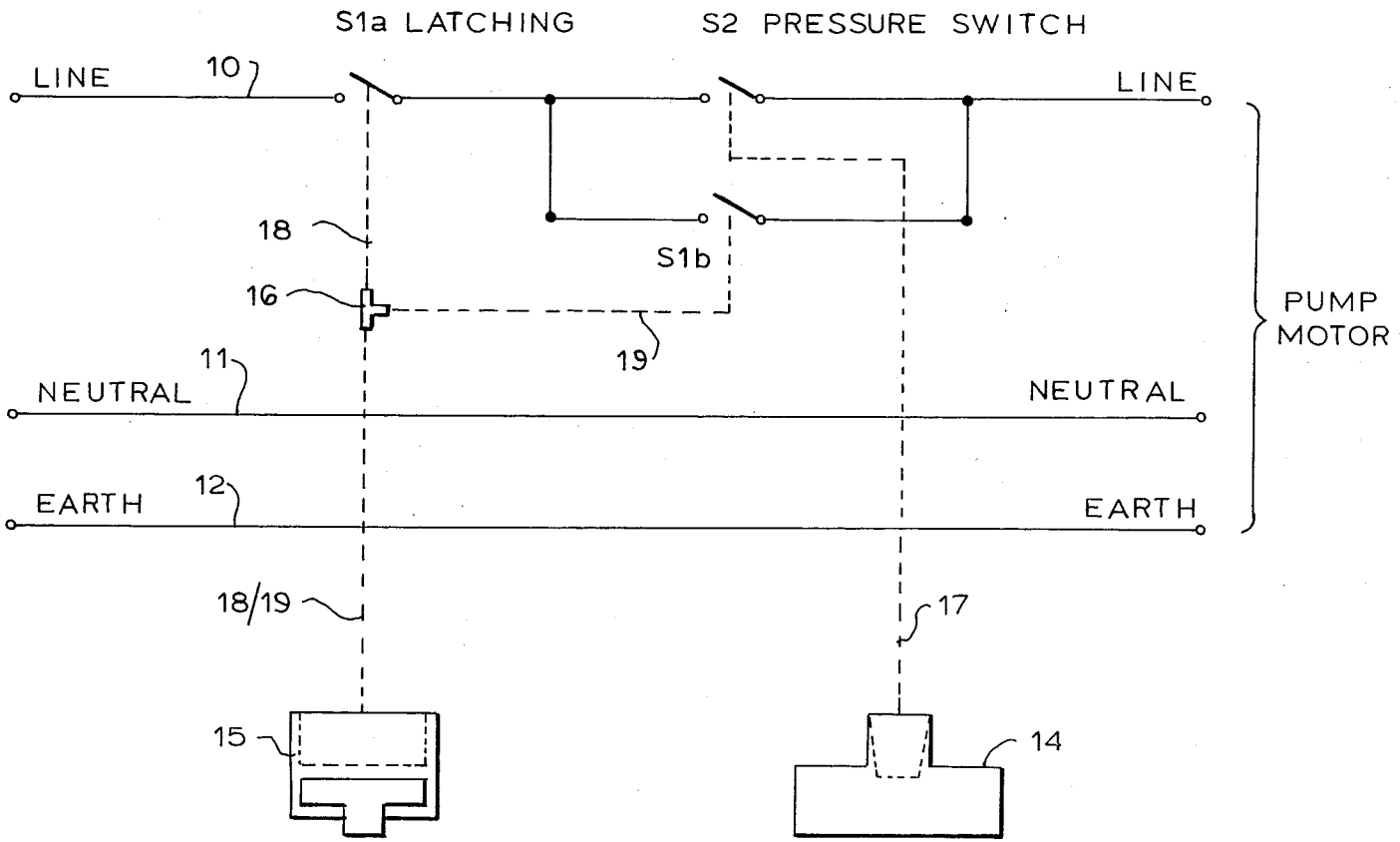
FIG. 1 is a pump protection system in accordance with the invention, for a whirlpool, bath using direct electrical switching.

The pump protection system shown in FIG. 1, for a domestic whirlpool bath, is for protecting a pump driven by an electric motor (not shown) which is connected to the usual line and neutral power supply lines 10 and 11 and to an earth 12.

Supply to the motor is controlled directly by two switches S2 and S1*a* in the line 11 which are air-pressure actuable switches, for example of the construction shown in FIGS. 4 and 5 to be referred to later. Switch S2 is a simple ON-OFF switch being ON when the actuating air-pressure signal is present (positive) and OFF when there is no such signal. Switch S1*a* in contrast is a latching switch which first sets to ON when an air-pressure signal is received by the switch and then remains ON when the signal is no longer there, the switch only changing to OFF when a further positive air-pressure signal is received.

Connected in parallel with switch S2 is a further air-pressure actuable switch S1*b* which is like switch S2. Switches S1*b* and S2 are not of exactly the same type, though they are similar: S2 is a pressure switch designed, due to the choice of spring internally, to switch at a range of pressures which is adjustable using a fine adjustment screw; S1*b* is simply a switch with no adjustability.

The air-pressure signals for actuating the switches S2, S1*a* and S1*b* are generated by two devices, namely a diaphragm pressure sensor 14 and a diaphragm push-button 15. Instead of diaphragm devices, bellows devices could be used.

The sensor 14 is, when installed, located in the outlet pipe leading from the pump so that in operation it senses the dynamic pressure of water created by the pump at its outlet. Thus, the increased pressure in the water during pumping operation causes the diaphragm or bellows to deflect and generate an air pressure signal which is fed via an air signal line 17 to the switch S2 to actuate that switch to close it (ON).

The push-button 15 is a manually operable device. When the button is pressed it deflects a diaphragm or bellows to send air signals via two air signal lines 18 and 19 to the switches S1*a* and S1*b*. From the push-button 15 there is a single air line, labelled 18/19, which divides at a tee-piece 16 in the "control box" to the individual lines 18 and 19, as close to the switches S1*a* and S1*b* as possible to minimise the volume of air between those switches and the push-button 15.

Switches S1*a* and S1*b* do not need to be adjustable. The push-button 15 is pressed until sufficient air pressure is developed to trip those switches. When the button 15 is released those air-pressure signals cease.

The operation is as follows: Before the whirlpool bath is filled, i.e. with the pump dry and not operating, no air signal is generated by the sensor 14 so switch S2 remains open (OFF) and no power gets to the motor. (A safeguard is provided to prevent damage if the motor is tried to be run in this condition by someone pressing the push-button 15, as will be referred to later). When there is water in the bath, the user presses push-button 15 to generate air signals to close both switches S1*a* and S1*b* thereby to connect power to the motor and start the pump which almost immediately generates an outlet water pressure. This dynamic water pressure operates the sensor 14 to send an air signal to switch S2 to close that switch.

When the push-button 15 is released its signals cease and switch S1*b* opens but latching switch S1*a* remains closed. Power thus continues to the motor through both switches S1*a* and S2.

If whilst the pump is running the inlet to the pump becomes blocked, the pump outlet pressure drops, the sensor 14 no longer generates an air pressure signal and therefore switch S2 will open to protect the pump from overheating. The same protection procedure would be followed if the bath drained whilst the pump is operating.

The pump can now only be restarted (once the blockage has been removed or the bath re-filled) by pressing the push-button 15 twice, once to re-set the latching switch to OFF and again to close both switches S1*a* and S1*b* to energise the pump motor.

The advantage of using a latching switch that has to be manually re-set by the push-button 15 is that with the pump operating normally, when the user wants to switch if off, e.g. to empty the bath, he simply presses the push-button 15 which causes the latching switch S1*a* to open.

The sensor 14 is designed to operate at a pressure of around 1 or 2 p.s.i. This may be adjustable, either at the sensor 14 and/or at the switch S2. The operating air pressure of the push-button device 15 and/or of the switches S1*a* and S1*b* may but need not normally be adjustable.

The sensor 14 and push-button device 15 are both non-electrical and are connected to the electrical switches S1*a*, S1*b* and S2 only by the air signal lines 17,18,19 so that their operation is quite safe even though they are operated in wet conditions. The electrical supply lines 10 to 12 and the motor itself may be located at a remote, safe distance from the bath interior.

As an optional feature, there may be provided a safeguard to prevent the ON switch push-button 15 from being held ON whilst the whirlpool bath is empty, which might unwittingly cause the pump motor and pump to run whilst dry for a prolonged period as long as the button 15 is held down; this might happen if a small child played with the bath when empty or an object was inadvertently placed over or against the button 15. To avoid this, a carefully sized bleed hole (not shown) may be provided in the line 18/19 or line 19 which has the effect of limiting the time for which the switch S1*b* will remain closed. The time is limited according to the diameter of the bleed hole and might typically be 3 seconds for a bleed hole diameter of 0.3 mm.

In practice, the bleed hole may conveniently be drilled in the tee-piece 16; or it may be a calibrated orifice built in to the tee-piece or at some other location. The bleed hole must be of sufficiently small diameter to avoid too much loss of air from the system whilst switching is actually taking place.

Naturally there could be other ways of providing such a safeguard though other arrangements would involve detecting the presence of water either in the pump or in the suction pipe by either electrical or mechanical means, and since one of the purposes of the pump protection system in accordance with the invention is to avoid using such devices the bleed hole arrangement or some other time limiting safeguard feature is preferred. However, such other arrangements could be used in combination with the pump protection system of the invention, if required.

Figure 2:
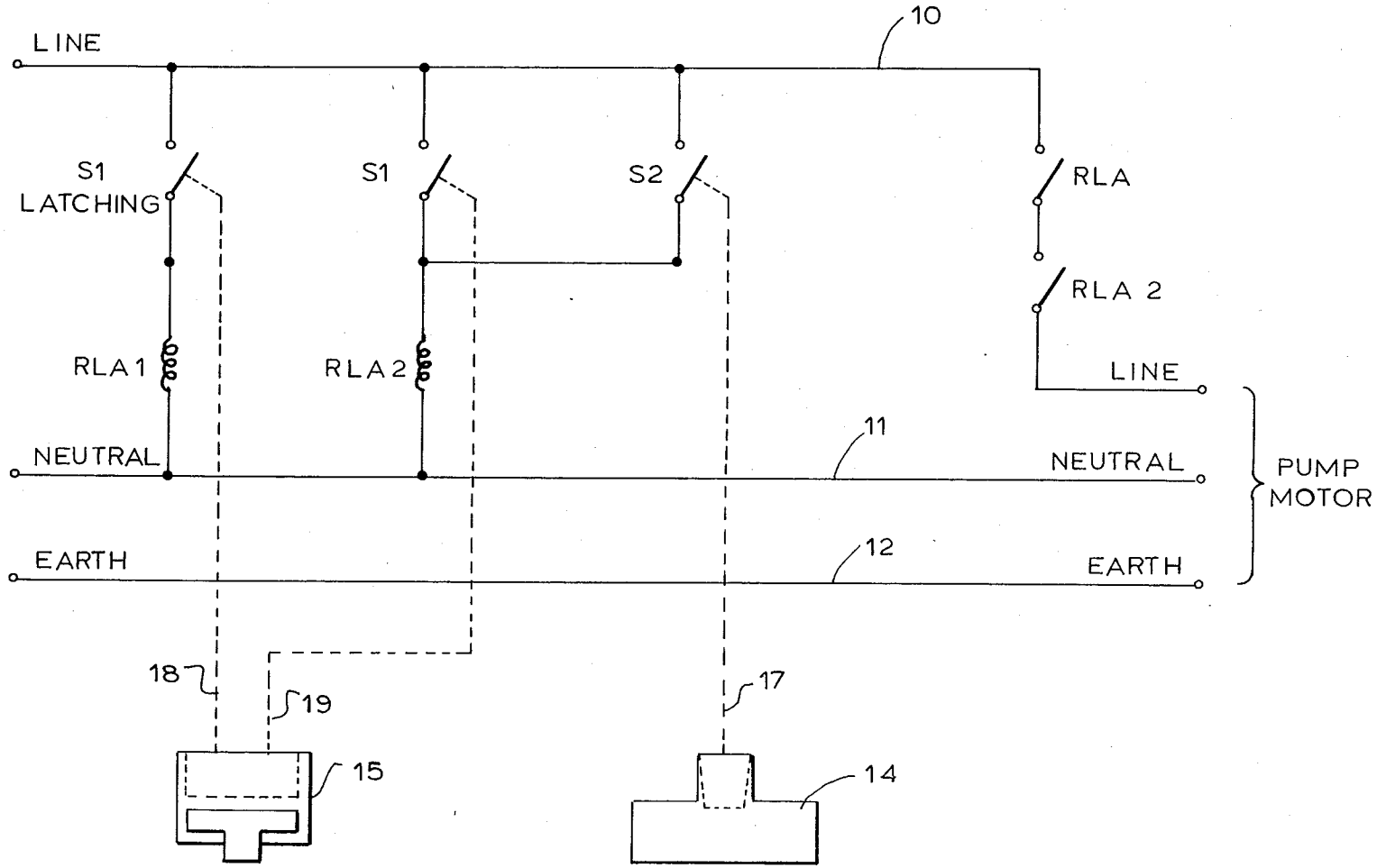
FIG. 2 is a system similar to that of FIG. 1 but using indirect electrical switching via relays.

The protection system shown in FIG. 2 works in principle in a similar way to that shown in FIG. 1 and where appropriate the same references have been used.

The main difference is that the switches S1*a*, S1*b* and S2 instead of acting directly in the power supply line 10 are connected between line 10 and neutral 11 so that by including suitable current limiters (not shown) they do not carry the full supply current. Rather, the switches control relays RLA 1 and RLA 2, the switch contacts of which are connected in the line 10.

In this embodiment, separate air lines 18 and 19 are shown connected to the push-button 15 though in practice there would probably again be a single line dividing at a tee-piece as for the embodiment of FIG. 1.

In operation, when the whirlpool bath (and therefore the pump pipework) have water in them and the push-button 15 is pressed, the latching switch S1*a* closes thereby causing energisation of relay RLA 1 and closing of its switch contacts in line 10; also switch S1*b* closes thereby causing energisation of relay RLA 2 and closing of its switch contacts in line 10; the pump motor is thus energised and the pump generates water pressure which actuates the sensor 14 which in turn closes switch S2.

The push-button 15 is then released and switch S1*b* will open but relay RLA 2 will remain energised through switch S2 as long as the pump outlet pressure is maintained. Also, relay RLA 1 will remain energised through the latching switch S1*a*.

If the pump inlet gets blocked or the water drains out of the pump, the pump outlet pressure will fall, sensor 14 will no longer generate a signal, switch S2 will therefore open to de-energise RLA 2 and its switch contacts will open to cut out the pump motor.

To re-start the pump when normal operating conditions are restored, the push-button 15 must be pressed twice; the first time will un-latch switch S1*a* and the second pressing closes both switches S1*a* and S1*b* as before.

To stop the pump whilst it is running normally, e.g. before emptying the bath, the push-button 15 is simply pressed once to unlatch switch S1*a* and open relay switch contacts RLA 1.

A safeguard to prevent prolonged operation of the motor with the bath empty by holding down the button 15, may be provided by means of a bleed hole in the line 19 as decribed above for FIG. 1.

Figure 3:
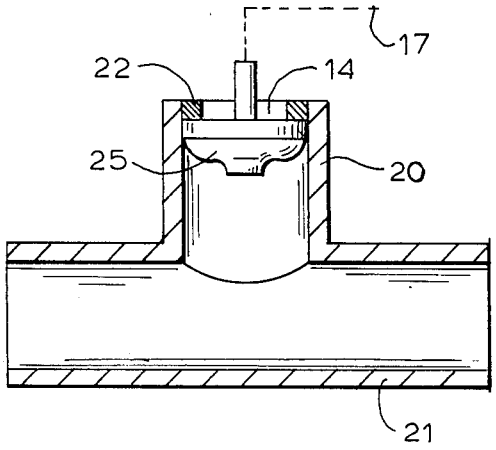
FIG. 3 is an embodiment of a diaphragm pressure sensor.

The diaphragm pressure sensor 14 shown in FIG. 3 is located in a branch 20 of the pump outlet duct 21 leading from the pump to a nozzle or nozzles in the whirlpool bath wall. A small plastics collar 22 is cemented in the end of the branch 20 to hold the sensor 14 in place. Water pressure in the duct 21 and branch 20 acts to deflect the diaphragm 25 and cause a small air pressure signal to pass along the signal line 17.

Figure 4:
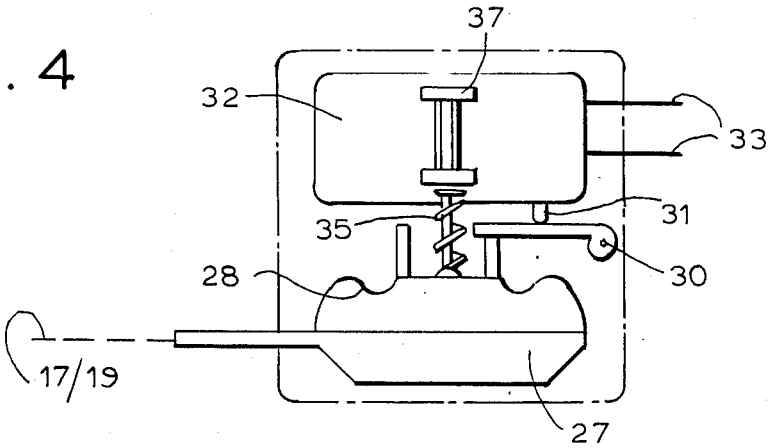
FIG. 4 is an embodiment of an air-pressure actuable switch, being a pressure ON, no pressure OFF switch.

The air-pressure responsive switch shown in FIG. 4 has a receiving chamber 27 to which an air pressure signal is fed by the signal line 17 or 19, a wall of the chamber 27 being a diaphragm 28 which deflects upwardly to pivot a rocker 30 which depresses the button 31 of a microswitch 32. When the button 31 is depressed, the contacts 33 of the microswitch are closed. A return spring 35 ensures that the diaphragm 28 relaxes and that the button 31 can move to its OFF position when the air signal in line 17 or 19 is no longer present. An adjusting screw 37 can be used to set the air pressure at which the air signal actuates the switch.

Figure 5:
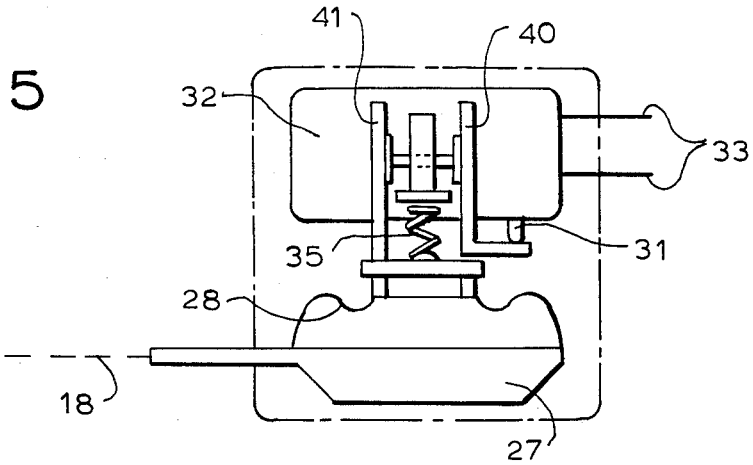
FIG. 5 is an embodiment of an air-pressure actuable switch, being a latching switch.

The air-pressure responsive latching switch shown in FIG. 5 is generally similar to the ON-OFF switch shown in FIG. 4, the difference being that deflection of the diaphragm 28 causes movement of a latch even when the diaphragm 28 relaxes. When the diaphragm 28 deflects a second time it raises both the latch member 40 and the latch release member 41 to unlatch member 40 and allow it to fall when the diaphragm again relaxes, causing the microswitch to be switched off.

In the above embodiments, the pressure diaphragm 14 is intended to be used in the pump outlet. If a pressure sensor is to be used in the pump inlet it would need to respond only at a pre-determined suction pressure but not if the pressure falls below that value or rises to zero. Possibly two pressure transducers would be needed to achieve this.

Also, whilst the above description has referred to positive actuating signals, it will be appreciated that embodiments could be designed with a converse arrangement where for example the switches are operated when a signal ceases.

The pump protection system could also be used with pump assisted shower units. Such pumps are necessary when the header tank is located at too low a level to give a sufficient head for showering. They are usually installed on the down-stream side of the shower valve. However, if the pump system pumps, simultaneously, hot and cold feds to the shower mixer valve, the protection of the pump system might have to be based on the alternative system which senses a change in pressure on the suction line, since otherwise a system sensing pressure at the pump outlet might not switch off the pump if only one of the supplies became blocked and damage to that side of the dual impeller pump could ensue.

I claim:

1. A protection system for a liquid pump, comprising a protection switch connected to a sensor for sensing a flow characteristic of liquid flow through the pump and for producing a signal indicative of the existence of that characteristic, means for rendering the pump operative or inoperative in dependence upon the presence or absence of a signal from the sensor, a manual override means for rendering the pump operative in the absence of a signal from the sensor and an override switch to switch off said pump, said override switch being connected to two signal-responsive switches, one for overriding the protection system and the other a latching switch establishing a control line in series with said protection switch.

2. The protection system as claimed in claim 1, in which the means for rendering the pump operative or inoperative, and/or the manual override means, acts on the power supply to a motor for driving the pump.

3. The protection system as claimed in claim 1, in which the pump is driven by an electric motor, and in which the signal responsive switches act directly upon the electrical power supply to the motor which drives the pump.

4. The protection system as claimed in claim 1 in which the pump is driven by an electric motor, and in which the signal responsive switches are connected to operate relays (which switch) to control the electrical power supply to the motor.

5. The protection system as claimed in claim 1 includes a domestic pump installation for a bath or shower, having a pump driven by an electric motor wherein the sensor and manually operable switch are pneumatic signal generating devices connected to actuate remote electrical switching controlling the motor.

6. The protection system as claimed in claim 1, in which the sensor includes means to sense a positive dynamic pressure and an absence of such pressure generated at the pump outlet.

7. The protection system as claimed in claim 6, in which the means to sense said dynamic pressure is adapted to generate a pneumatic signal which is used to operate a pneumatic-pressure responsive switch controlling the pump.

8. A protection system as claimed in claim 6 or 7, in which the manual override means is a manual pneumatic switch which generates a pneumatic signal for operating a pressure-responsive switch.

9. A protection system as claimed in claim 6, in which the pneumatic sensor and/or manual override means are air signal-generating devices.

10. A protection system as claimed in claim 8, in which the air signal-generating devices each include a movable diaphragm or bellows.

11. The protection system as claimed in claim 1, in which means is provided to limit a period of time of effective operation of the manual override means.

12. The protection system as claimed in claim 11, in which the manual override means is a manual pneumatic switch connected by a pneumatic line to a pressure-responsive switch, and in which the means for limiting the period of time of effective operation of the override means comprises a bleed hole in the pneumatic line.

13. The protection system as claimed in claim 1, wherein said sensor is a flow motion sensor positioned at said pump inlet means for rendering the pump operative or inoperative in dependence upon the presence or absence of a signal from the sensor.

14. The protection system, as claimed in claim 13, wherein the sensor is a flow motion sensor positioned at the pump outlet.

15. The protection system as claimed in claim 1, wherein said signal received from the sensor activates means for rendering the pump operative or inoperative in dependence upon the presence or absence of said signal.

* * * * *